US009367031B2

(12) United States Patent
Wada

(10) Patent No.: US 9,367,031 B2
(45) Date of Patent: Jun. 14, 2016

(54) PROCESS CARTRIDGE

(71) Applicant: CANON KABUSHIKI KAISHA, Tokyo (JP)

(72) Inventor: Koji Wada, Kawasaki (JP)

(73) Assignee: Canon Kabushiki Kaisha, Tokoy (JP)

( * ) Notice: Subject to any disclaimer, the term of this patent is extended or adjusted under 35 U.S.C. 154(b) by 0 days.

(21) Appl. No.: 14/848,694

(22) Filed: Sep. 9, 2015

(65) Prior Publication Data

US 2016/0070227 A1 Mar. 10, 2016

(30) Foreign Application Priority Data

Sep. 10, 2014 (JP) ..... 2014-183925

(51) Int. Cl.
*G03G 21/00* (2006.01)
*G03G 21/18* (2006.01)

(52) U.S. Cl.
CPC ..... *G03G 21/1814* (2013.01)

(58) Field of Classification Search
USPC ..... 399/107, 110, 111–117, 127, 128
See application file for complete search history.

(56) References Cited

U.S. PATENT DOCUMENTS

| | | | | |
|---|---|---|---|---|
| 4,738,117 | A | 4/1988 | Takasugi | |
| 5,974,288 | A * | 10/1999 | Sato | G03G 15/0896 222/DIG. 1 |
| 6,738,588 | B2 | 5/2004 | Yokomori et al. | |
| 6,826,380 | B2 * | 11/2004 | Karakama | G03G 21/1871 399/111 |
| 6,980,758 | B2 * | 12/2005 | Murayama | G03G 21/1839 399/111 |
| 7,155,140 | B2 | 12/2006 | Arimitsu et al. | |
| 8,874,010 | B2 | 10/2014 | Wada | |
| 2005/0169664 | A1 | 8/2005 | Arimitsu et al. | |
| 2014/0363196 | A1 | 12/2014 | Wada et al. | |

FOREIGN PATENT DOCUMENTS

| | | | |
|---|---|---|---|
| JP | 2001-142365 | A | 5/2001 |
| JP | 2002-189400 | A | 7/2002 |
| JP | 2003-295717 | A | 10/2003 |
| JP | 2005-242332 | A | 9/2005 |
| JP | 2006-276529 | A | 10/2006 |
| JP | S62-186181 | U | 11/2007 |
| JP | 2010-224199 | A | 10/2010 |

* cited by examiner

*Primary Examiner* — Hoan Tran
(74) *Attorney, Agent, or Firm* — Fitzpatrick, Cella, Harper & Scinto

(57) ABSTRACT

A process cartridge includes a photosensitive drum; a light guide member; a shutter portion movable between a closed position where the shutter portion covers the surface of the drum and an open position where the surface of the drum is exposed; and a connecting portion, provided at each of end portions of the shutter portion with respect to an axial direction of the drum, for connecting the shutter portion so as to be movable relative to a main body portion of the process cartridge. The light guide member includes an incident portion, at one end portion thereof with respect to the axial direction of the drum, for irradiating the surface of the drum with light incident on the incident portion. The incident portion is positioned outside the connecting portion with respect to the axial direction of said photosensitive drum.

9 Claims, 12 Drawing Sheets

(a)

(b)

(a)

(b)

(c)

PROCESS CARTRIDGE

FIELD OF THE INVENTION AND RELATED ART

The present invention relates to a process cartridge for use with an electrophotographic image forming apparatus.

The image forming apparatus forms an image on a recording material by using an electrophotographic image forming process. For example, the image forming apparatus includes an electrophotographic copying machine, an electrophotographic printer (LED printer, laser beam printer), an electrophotographic facsimile machine, an electrophotographic ward processor, or the like.

The process cartridge is prepared by integrally assembling an electrophotographic photosensitive drum as an image bearing member and a process means actable on the photosensitive drum into a cartridge (unit), and is made detachably mountable to the image forming apparatus. As the process means, a charging means, a developing means and a cleaning means are used, and herein, the photosensitive drum and at least the charging means are integrally assembled into a cartridge, which is made detachably mountable to the image forming apparatus.

A conventional electrophotographic image forming apparatus using the electrophotographic image forming process employs a type in which the electrophotographic photosensitive member (drum) and the process means actable on the electrophotographic photosensitive member are integrally assembled into a process cartridge, which is detachably mountable to the image forming apparatus. According to this type, a user can perform maintenance of the image forming apparatus by himself (herself) without relying on a service person, and therefore operativity can be remarkably improved. For that reason, this type has been widely used in image forming apparatuses.

The process cartridge is required that the photosensitive drum is exposed when the process cartridge is mounted in the image forming apparatus. However, the photosensitive drum has to avoid exposure to external light, direct touch with a hand, and damage by drop of the process cartridge before the photosensitive drum is mounted. Therefore, as shown in FIG. 12, in order to protect a photosensitive drum 2, an openable resin-made photosensitive member protecting member 318 (hereinafter, referred to as a shutter member) is provided. The shutter member 318 is constituted so as to be opened and closed when a process cartridge B is mounted in and demounted from an apparatus main assembly of the image forming apparatus. Such a constitution that the shutter member is opened and closed when the process cartridge is mounted in and demounted from the apparatus main assembly is disclosed in Japanese Laid-Open Patent Application (JP-A) 2005-242332.

Further, as shown in FIG. 12, the process cartridge includes a light guide means 80 (hereinafter, referred to as a pre-exposure member) for uniformly irradiating the photosensitive drum 2 with exposure light from the image forming apparatus main assembly with a sufficient light quantity in some cases. JP-A 2003-295717 discloses a constitution in which the process cartridge includes the light guide means. The pre-exposure member 80 is provided to prevent image defect (inconvenience) with reliability by making a photosensitive drum surface potential before charging constant. The pre-exposure member 80 includes an incident portion 80*b*, on which light is incident, at an end portion thereof with respect to a photosensitive drum axial direction of the process cartridge contacting the apparatus main assembly. Then, light emitted from a light source (not shown) provided in the image forming apparatus is incident on the incident portion 80*b*.

However, in the conventional constitutions, there is a problem described below. In the following description, a longitudinal direction of the process cartridge coincides with a rotational axis direction of the photosensitive drum (i.e., a direction in which the process cartridge is substantially parallel to the photosensitive drum). A cross-sectional direction of the process cartridge is a direction crossing (substantially perpendicular to) the rotational axis direction of the photosensitive drum.

First, the pre-exposure member 80 is disposed upstream of the charging means with respect to the rotational direction of the photosensitive drum 2 in cross-section thereof in order to make the surface potential of the photosensitive drum 2 before charging constant. The pre-exposure member 80 is disposed from a process cartridge end portion in the incident portion 80*b* side with respect to the longitudinal direction over an entire region with respect to the longitudinal direction of the photosensitive drum 2.

However, in the case where the shutter member 318 is disposed, a shutter arm portion 318*a* (hereinafter, referred to as a rotatable portion) is disposed outside a printing region of the photosensitive drum 2 with respect to the longitudinal direction in general.

For that reason, in the case where the pre-exposure member 80 exists in a rotation locus of the rotatable portion 318*a*, as shown in FIG. 12, there is a need to dispose the incident portion 80*b* of the pre-exposure member 80 inside the rotatable portion 318*a* so as to avoid interference with the rotation locus of the rotatable portion 318*a*. Here, it is difficult to dispose the light source (not shown) provided in the image forming apparatus inside the rotatable portion 318*a* with respect to the longitudinal direction while avoiding the inference with the rotation locus during the mounting of the process cartridge. For that reason, a distance between the incident portion 80*b* and the light source is increased, and therefore results in a factor of an increase in cost such as an increase in light quantity of the light source of the image forming apparatus for ensuring the light quantity in order to expose the photosensitive drum to light at a predetermined light quantity.

SUMMARY OF THE INVENTION

A principal object of the present invention is to provide a shutter member so as to suppress an increase in light quantity for pre-exposure.

According to an aspect of the present invention, there is provided a process cartridge detachably mountable to a main assembly of an image forming apparatus, comprising: a photosensitive drum; a light guide member for irradiating a surface of the photosensitive drum with light at a position downstream of a transfer position where a developer image is transferred from the photosensitive drum onto a developer image receiving material and upstream of a charging position where the photosensitive drum is electrically charged with respect to a rotational direction of the photosensitive drum; a shutter portion movable between a closed position where the shutter portion covers the surface of the photosensitive drum and an open position where the surface of the photosensitive drum is exposed; and a connecting portion, provided at each of end portions of the shutter portion with respect to an axial direction of the photosensitive drum, for connecting the shutter portion so as to be movable relative to a main body portion of the process cartridge, wherein the light guide member includes an incident portion, at one end portion thereof with respect to the axial direction of the photosensitive drum, for irradiating the surface of the photosensitive drum with light incident on the incident portion, and wherein the incident portion is positioned outside the connecting portion with respect to the axial direction of said photosensitive drum.

According to another aspect of the present invention, there is provided a process cartridge detachably mountable to a main assembly of an image forming apparatus, comprising: a photosensitive drum; a light guide member for irradiating a surface of the photosensitive drum with light at a position downstream of a transfer position where a developer image is transferred from the photosensitive drum onto a developer image receiving material and upstream of a charging position where the photosensitive drum is electrically charged with respect to a rotational direction of the photosensitive drum; a shutter portion movable between a closed position where the shutter portion covers the surface of the photosensitive drum and an open position where the surface of the photosensitive drum is exposed; and a connecting portion provided at each of end portions of the shutter portion with respect to an axial direction of the photosensitive drum, wherein the connecting portion connects the shutter portion with a main body portion of the process cartridge, and is rotatably relative to the main body portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

Figure 1:
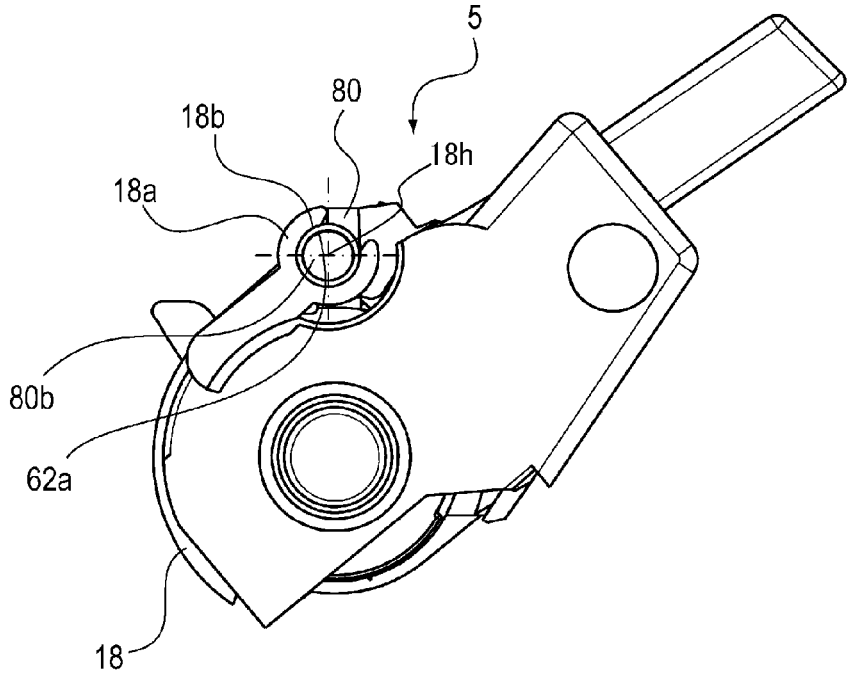
In FIG. 1, (a) and (b) are schematic views for illustrating states of a shutter member during opening and closing in Embodiment 1.
Figure 1:
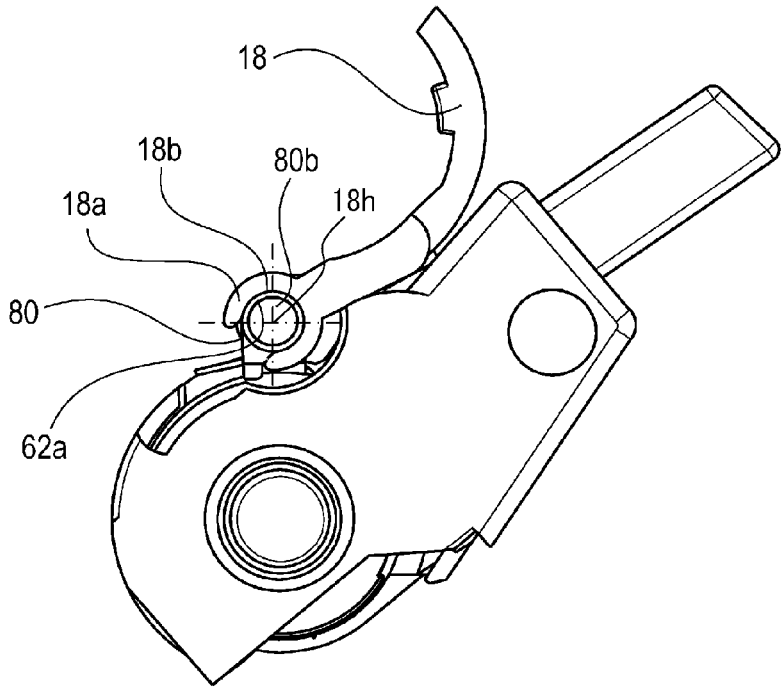

Embodiments of the present invention will be described specifically with reference to the drawings. However, with respect to functions, materials, shapes, relative arrangements and the like of constituent elements described in the following embodiments, the scope of the present invention is not intended to be limited to only the embodiments unless otherwise specified. Further, the materials, the shapes and the like of members which have already been described in the following description are the same as those first described in the following embodiment unless otherwise specified again.

Embodiment 1

A process cartridge according to the present invention will be described with reference to the drawings.

In the following description, a longitudinal direction of the process cartridge coincides with a rotational axis direction (a substantially parallel direction) of a photosensitive drum. A cross-sectional direction of the process cartridge is a direction crossing (substantially perpendicular to) a rotation shaft of the photosensitive drum.

(General Structure of Image Forming Apparatus)

First, a general structure of an image forming apparatus 1 in which the process cartridge according to this embodiment will be described with reference to FIG. 2. The image forming apparatus 1 shown in FIG. 2 forms an image with a developer on a recording material P depending on image information from an external device, such as a personal computer, communicatably connected with the image forming apparatus 1. The recording material P is subjected to image formation using an electrophotographic image forming process and includes, e.g., a sheet, an OHP sheet, cloth, and label and the like.

The photosensitive drum 2 is rotated in an arrow A direction, so that a surface of the photosensitive drum 2 is electrically charged uniformly by a charging member (charging roller) 3 as a charging means. Of positions on the surface of the photosensitive drum 2, a position where the photosensitive drum 2 is charged by generation of electric discharge due to a potential difference with the charging roller 3 (i.e., a charging nip where the photosensitive drum 2 contacts the charging roller 3 and the neighborhood thereof) is a charging position. The photosensitive drum 2 is irradiated with laser light L emitted from an optical means (exposure means) 4 depending on image information, so that an electrostatic latent image depending on the image information is formed on the photosensitive drum 2. Of the positions on the surface of the photosensitive drum 2, a laser light L irradiation position is an exposure position. The electrostatic latent image formed on the photosensitive drum 2 is developed with a toner t as a developer by a developer carrying member 22 described later, so that a toner image is formed. Of the positions on the photosensitive drum 2, a position where the toner t is deposited by the developing roller 22 is a developing position.

On the other hand, in synchronism with formation of the toner image, the recording material P set in a feeding cassette 6 is separated and fed one by one by a pick-up roller 7 and a press-contact member 9 press-contactable to the pick-up roller 7. Then, the recording material P is fed toward a transfer 10 as a transfer means along a feeding guide 8. Then, the recording material P passes through a transfer nip 10*a* formed by the photosensitive drum 2 and the transfer roller 10 to which a certain voltage is applied. At this time, the toner image formed on the photosensitive drum 2 is transferred onto the recording material P. Of the positions of the photosensitive drum 2, a position where the transfer nip 10*a* is formed is a transfer P. The recording material P on which the toner image is transferred is fed along a feeding guide 11 into a fixing means 12. The fixing means 2 includes a driving roller 12*a* and a fixing roller 12*c* incorporating a heater 12*b*. Then, heat and pressure are applied to the recording material P passing through a nip 12*d* formed by the fixing roller 12*c* and the driving roller 12*a*, so that the transferred toner image is fixed on the recording material P. Thereafter, the recording material P is fed by a discharging roller pair 13 and is discharged onto a discharge tray 14.

Figure 2:
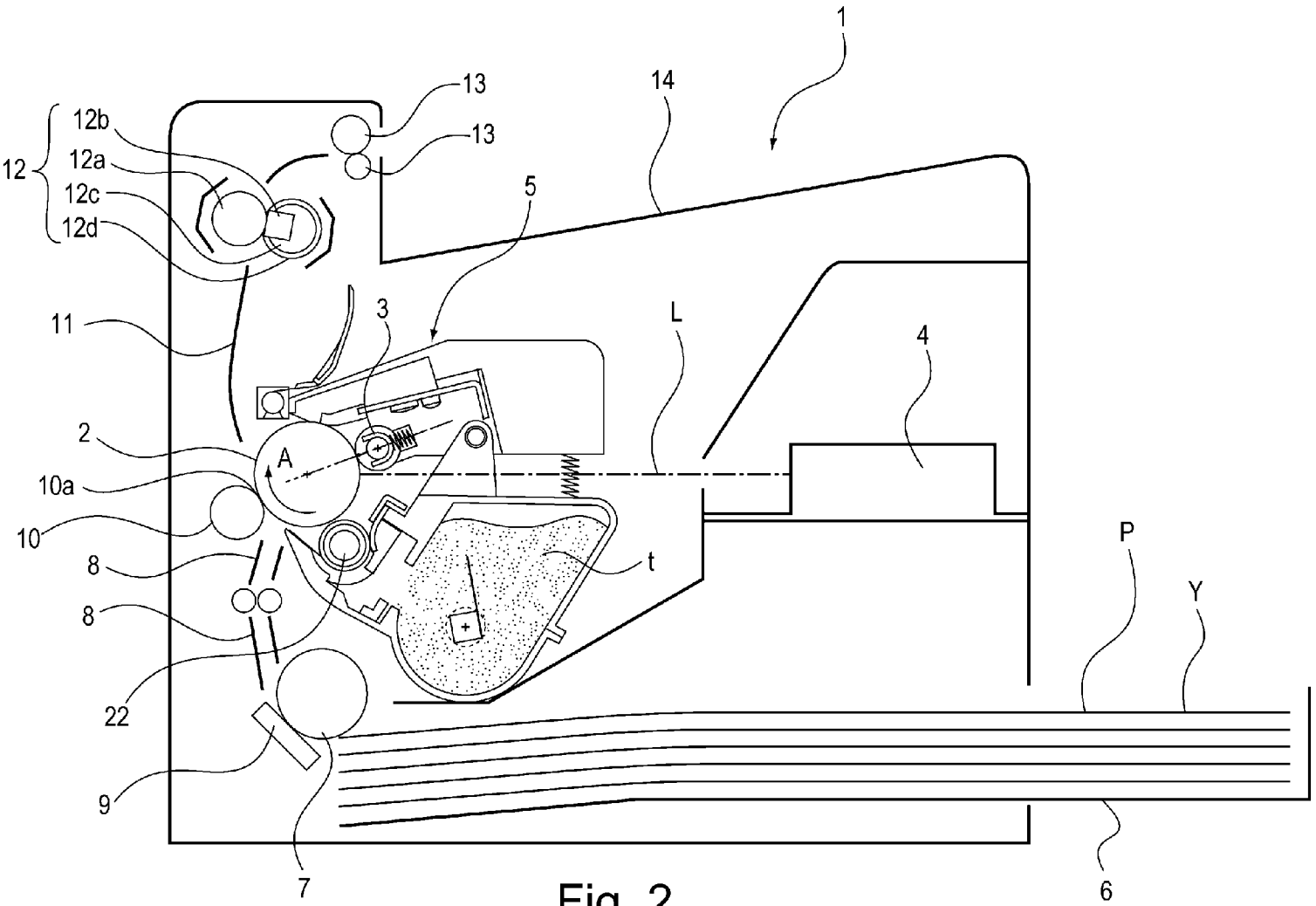
FIG. 2 is a schematic view showing a general structure of an image forming apparatus in which a process cartridge is mounted.

As shown in FIG. 2, it can be said that with respect to a rotational direction A of the photosensitive drum 2, from an upstream side toward a downstream side, the respective positions are disposed in the order of the charging position, the exposure position, the developing position, the transfer position, the charging position, . . . .

(Process Cartridge)

Figure 3:
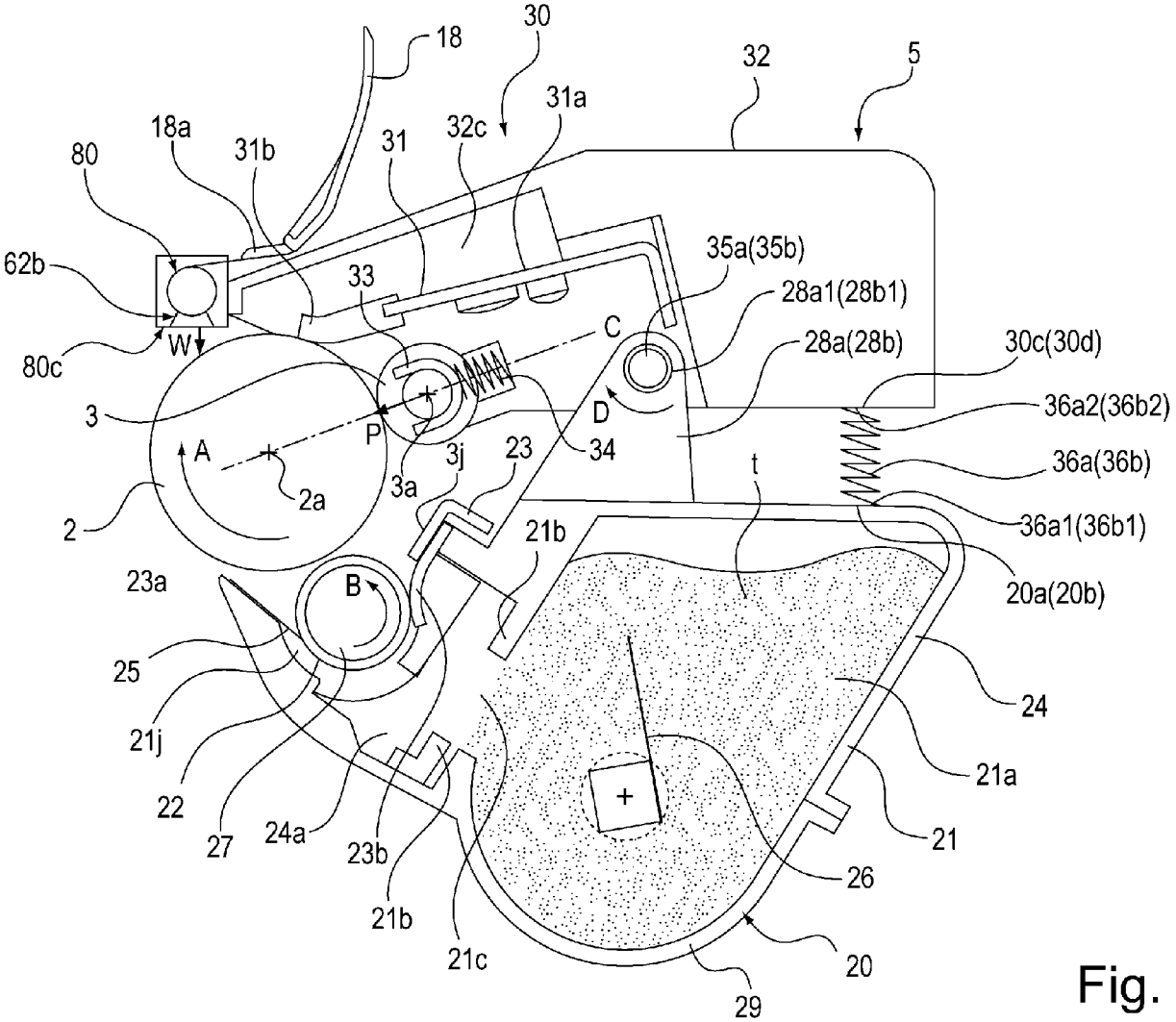
FIG. 3 is a schematic view showing a structure of the process cartridge.
Figure 4:
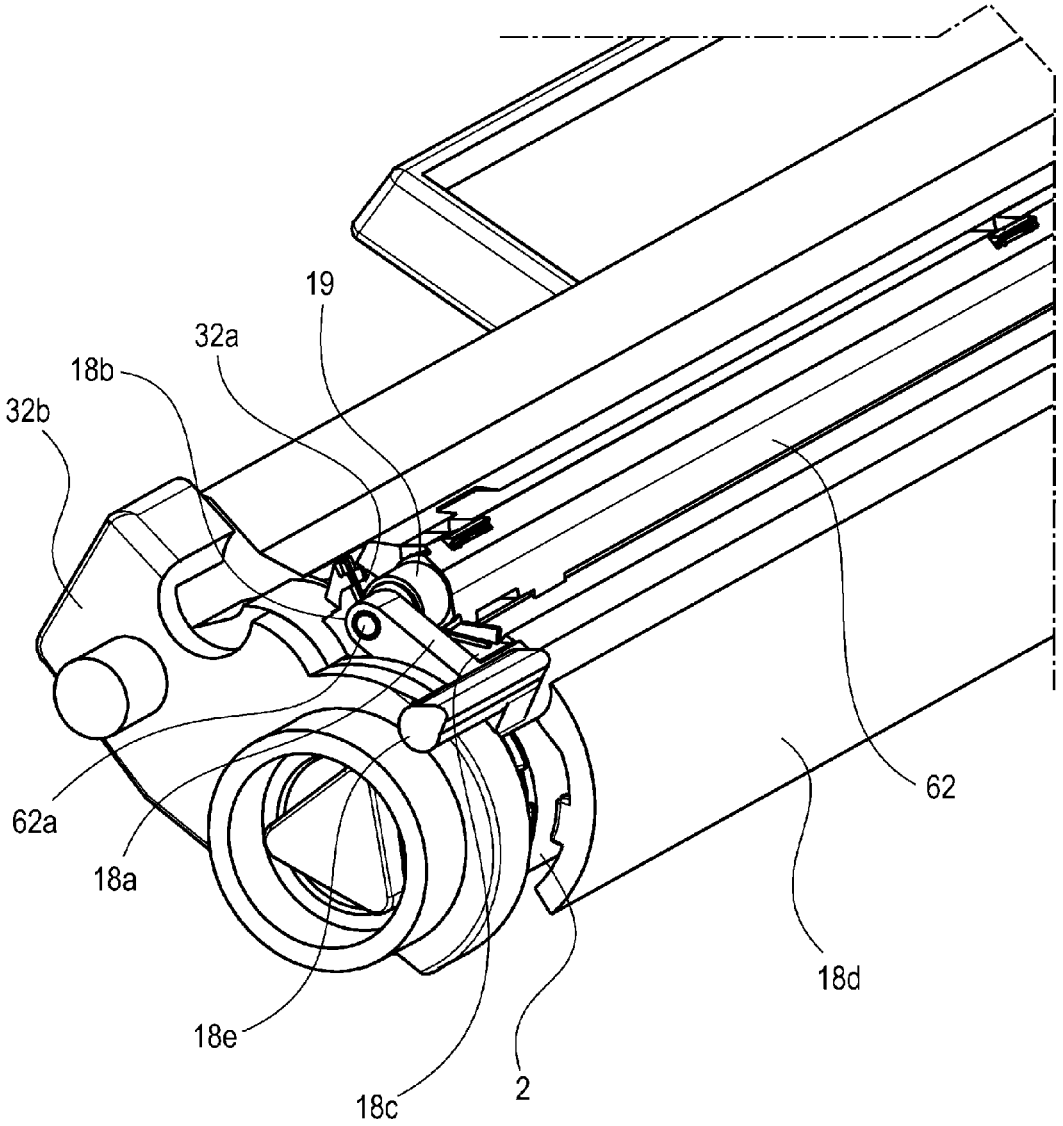
FIG. 4 is a perspective view showing an arrangement of the shutter member and a pre-exposure member.

A process cartridge 5 detachably mountable to the image forming apparatus 1 in this embodiment will be described with reference to FIGS. 3 and 4. FIG. 3 is a schematic sectional view showing a structure of the process cartridge 5.

As shown in FIG. 3, the process cartridge 5 is constituted by a photosensitive (member) unit 30 as a first unit and a developing unit 20 as a second unit. The photosensitive unit 30 includes the photosensitive drum 2, the charging roller 3, a cleaning means (cleaning blade) 31 and the like. Further, the developing unit 20 includes a developer roller 22.

The photosensitive drum 2 is rotatably mounted in a cartridge frame (cleaning frame) 32 of the photosensitive unit 30. Then, when a driving force of a driving motor (not shown) is transmitted to the photosensitive unit 30, the photosensitive drum 2 is rotated in an arrow A direction depending on an image forming operation.

In the neighborhood of a periphery of the photosensitive drum 2, the charging roller 3, the cleaning blade 31 and a pre-exposure member 80 are disposed. The pre-exposure member 80 is a member (for effecting the exposure before the charging) for making a surface potential of the photosensitive drum 2 uniform after a developing step and before a charging step by subjecting the photosensitive drum 2 before the charging to the light exposure.

The cleaning blade 31 is constituted by a blade supporting portion 31*a* and a cleaning portion 31*b* integrally molded with or bonded to the blade supporting portion 31*a*. Then, the cleaning portion 31*b* is contacted to the photosensitive drum 2, so that the toner remaining on the surface of the photosensitive drum 2 is scraped off. Then the residual toner scraped off from the photosensitive drum surface is accommodated in a residual toner accommodating portion 32*c*.

To the cleaning frame 32, a charging roller bearing 33 is mounted movably in an arrow C direction passing through a center of the charging roller 3 and a center of the photosensitive drum 2. A shaft (axis) 3*a* of the charging roller 3 is rotatably mounted to the charging roller bearing 33. The bearing 33 is in a state in which the bearing is pressed toward the photosensitive drum 2 in an arrow P direction by a pressing member 34.

Figure 6:
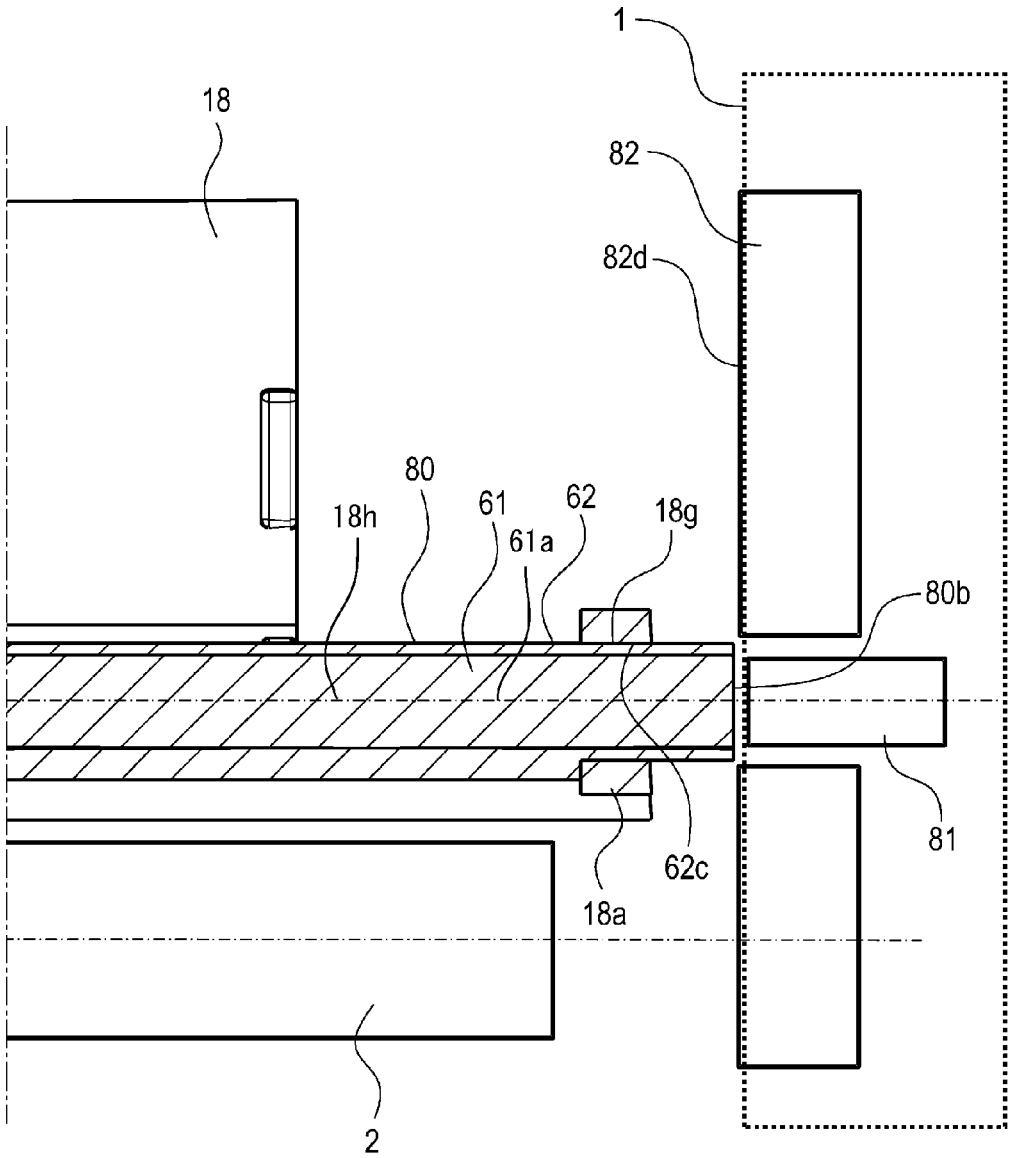
FIG. 6 is a schematic view showing a longitudinal relationship among the shutter member, the pre-exposure member and a light source.

Further, to the cleaning frame 32, the pre-exposure member 80 is mounted using a fixing means such as a double-side tape in a position upstream of the charging roller 3 and downstream of a transfer roller 10 (FIG. 2) with respect to the rotational direction of the photosensitive drum 2. That is, as shown in FIG. 3, with respect to the rotational direction (arrow A direction), a position where the surface of the photosensitive drum 2 is irradiated with light emitted from the pre-exposure member 80 is downstream of the transfer position and upstream of the charging position. The pre-exposure member 80 is disposed with a certain distance from the photosensitive drum 2, and irradiates the surface of the photosensitive drum 2 with exposure light from an image forming apparatus main assembly in an arrow W direction through an incident portion 80*c* (FIG. 1). Here, as shown in FIG. 6, the light exposure from the image forming apparatus main assembly is realized emitting light from a light source 81 as a light-emitting portion provided in the image forming apparatus main assembly toward the incident portion 80*c* as a light-receiving portion provided at one longitudinal end portion of the pre-exposure member 80. As a result, a surface potential of the photosensitive drum 2 before the charging is made constant, so that an image defect such as lateral stripe or positive ghost no the drum is suppressed with reliability.

A openable resin-made shutter member 18 includes a rotatable portion (connecting portion) 18*a* rotatably supported by the photosensitive unit 30, and opens and closes by rotation of the rotatable portion 18*a* when the process cartridge 5 is mounted and demounted from the image forming apparatus 1. Detailed description of the pre-exposure member 80 and the shutter member 18 will be made hereinafter.

On the other hand, the developing unit 20 includes a toner accommodating container 21 for accommodating a magnetic one-component developer t (toner), as the developer in this embodiment, consisting substantially only of magnetic resin toner particles (which may contain an external additive) and includes a developing chamber 24*a*.

The toner accommodating container 21 is formed by fixing a developing frame 24 and a toner container cap 29 by welding or the like. The toner accommodating container 21 includes a toner accommodating portion 21*a* for accommodating the toner t, a partition wall portion 21*b* for partitioning the inside of the container 21*a* into the toner accommodating portion 21*a* and the developing chamber 24*a*, and a toner supplying opening 21*c* for communicating the toner accommodating portion 21*a* and the developing chamber 24*a* with each other.

In the developing unit 20, the developing roller 22 for forming a visible image by supplying the toner on the electrostatic latent image formed on the photosensitive drum 2 is disposed. Further, in the developing unit 20, a developing blade 23 for forming a toner layer on the surface of the developing roller 22 by imparting triboelectric charges to the toner in contact with the developing roller 22 when the developing roller 22 rotates is disposed.

By connection with the developing frame 24, the toner container cap 29 for forming the developing chamber 24*a* and a lower opening 21*j* between the cap 29 and the developing roller 22 are formed. At the lower opening 21*j*, a leakage-preventing sheet 25 for preventing toner leakage through the lower opening 21*j* is provided.

The toner in the toner accommodating portion 21*a* is fed toward the developing chamber 24*a* side through the toner supplying opening 21*c* by rotation of a stirring member 26, and then is sent to the developing roller 22.

The developing roller 22 incorporates a fixed magnet 27 and rotates in an arrow B direction. A developing blade 23 is prepared by integrally molding or bonding a blade supporting portion 3*j* with a developer thickness regulating portion 23*b* for regulating a developer layer thickness in contact with the developing roller 22. The toner sent to the developing roller 22 is supplied with the triboelectric charges by the developing roller 22 and the developing blade 23 and also a layer thickness thereof is regulated by the developing blade 23, whereby the toner layer is formed on the surface of the developing roller 22.

As shown in FIG. 3, pressing springs 36*a* and 36*b* provided at two positions of longitudinal end portions of the developing unit 20 are compressed between receiving surfaces 30*c* and 30*d* of the photosensitive unit 30 and supporting portions

20*a* and 20*b* of the developing unit 20. As a result, the developing unit 20 is urged toward the photosensitive drum 2 by moment D around connecting shafts 35*a* and 35*b*.

Then, the toner formed in the layer on the surface of the photosensitive drum 2 is supplied to a developing region of the photosensitive drum 2. The toner is transferred onto the photosensitive drum 2 depending on the electrostatic latent image formed on the photosensitive drum 2, so that a toner image is formed.

When the process cartridge 5 is properly mounted in the image forming apparatus 1 (FIG. 2), contacts (not shown) of the image forming apparatus 1 and contacts (not shown) of the process cartridges 5 are electrically connected with each other. Thus, a predetermined charging bias and a predetermined developing bias are applicable from a voltage applying means (not shown) provided in the image forming apparatus 1 to the charging roller 3 and the developing roller 22, respectively.

Similarly, when the process cartridge 5 is properly mounted in the image forming apparatus 1 (FIG. 2), drive transmitting portions (not shown) of the image forming apparatus and the process cartridge 5 are connected with each other. Thus, a driving force is capable of being transmitted from a driving means (not shown) such as a driving motor provided in the image forming apparatus 1 to the process cartridge 5.

(Shutter Member and Pre-Exposure Member)

Figure 5:
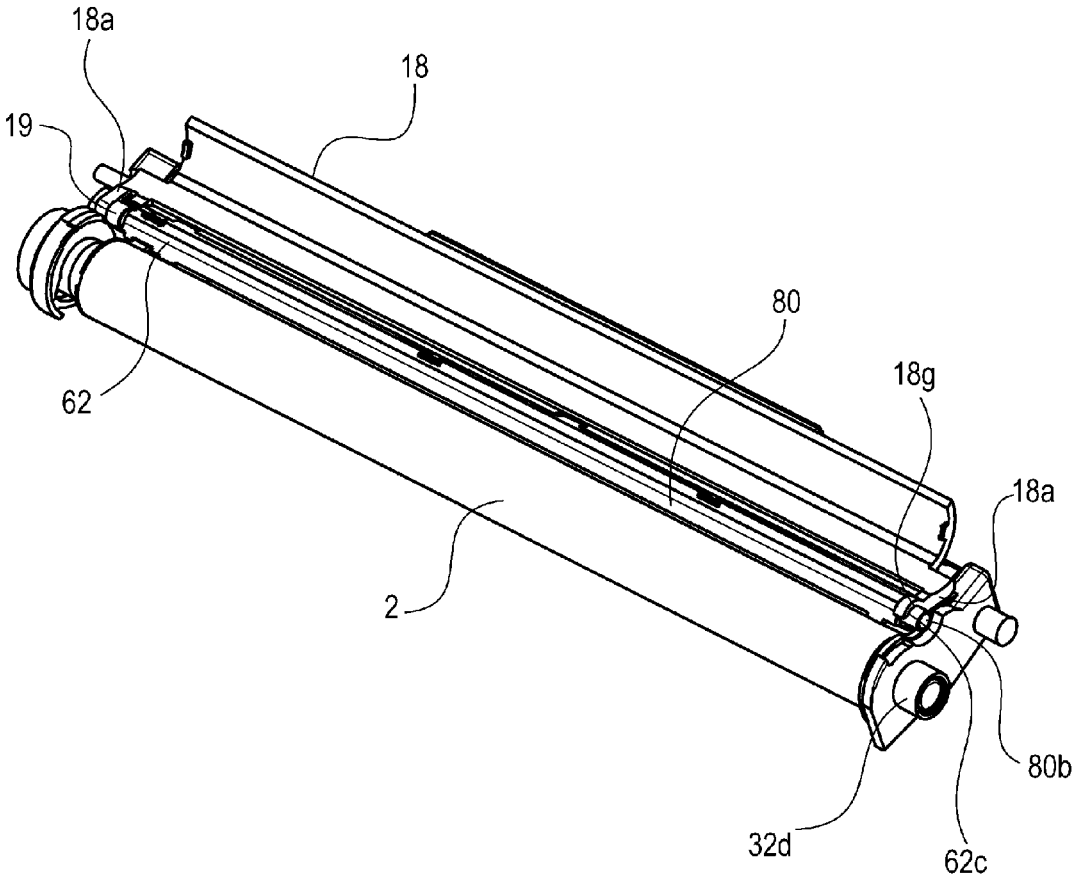
FIG. 5 is a perspective view showing an arrangement of the shutter member and the pre-exposure member.

Structures and an arrangement of the shutter member 18 and the pre-exposure member 80 will be described using FIGS. 4 to 6. Here, of the members constituting the process cartridge 5, the developing unit 20 (FIG. 3) does not relate to detailed description below, and therefore will be omitted from description. FIG. 4 is a perspective view showing the arrangement of the shutter member 18 and the pre-exposure member 80 (in a side opposite from the incident portion 80*b* at a closed position where the shutter member 18 covers the photosensitive drum 2). FIG. 5 is a perspective view showing the arrangement of the shutter member 18 and the pre-exposure member 80 (at an open position where the shutter member 18 exposes an opposing portion (FIG. 2) of the photosensitive drum 2 to the transfer roller 10). FIG. 6 is a schematic view showing a longitudinal positional relation among the shutter member 18, the pre-exposure member 80 and the light source 81.

First, the pre-exposure member 80 and the light source 81 which are a light guide member will be described. As shown in FIGS. 4 to 6, the pre-exposure member 80 is constituted by a substantially cylindrical lens 61 as a light-guiding member for guiding light receiving from the light source 81 to the photosensitive drum 2 by transmitting and reflecting the light and by an outer casing 62 having a white inner surface for enhancing a reflection efficiency of the lens 61.

The lens 61 is disposed in substantially parallel to an axial direction (longitudinal direction) of the photosensitive drum 2 and includes the incident portion 80*b* at one axial end surface thereof. The lens 61 effects reflection of the received light by the outer casing described later having the while inner surface, so that an entire longitudinal region of the surface of the photosensitive drum 2 is irradiated with the light, and therefore is provided with a plurality of uneven groove portions (projected and recessed groove portions (now shown)) provided in parallel at an opposing portion to the photosensitive drum 2 over an entire region with respect to the axial direction. Incidentally, mutual distance and shape of these uneven groove portions (not shown) are devised, so that the photosensitive drum surface can be uniformly irradiated with the light with respect to the longitudinal direction (JP-A 2003-295717).

The outer casing 62 covers the lens 61 and is provided at an opposing position to the photosensitive drum 2 with an emitting opening 62*b* (FIG. 3) for permitting irradiation of the photosensitive drum 2 with the light through the lens 61 in an arrow W direction. The outer casing 62 further includes supporting portions 62*a* and 62*c* at end portions thereof for supporting the shutter member 18 at the end portions.

Figure 9:
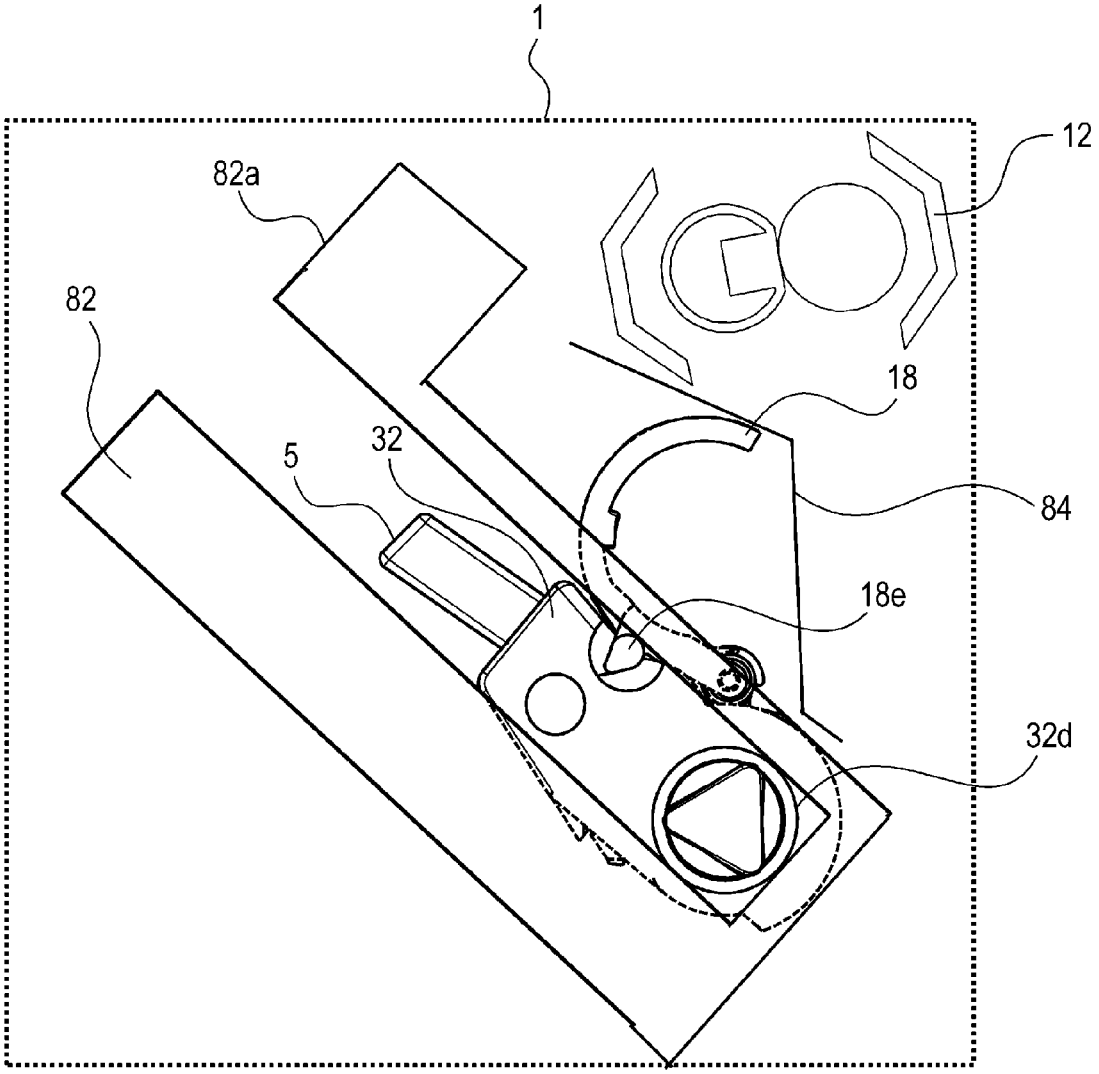
FIG. 9 is a schematic view showing a space between a main assembly and the process cartridge during mounting of the process cartridge in the main assembly.

As shown in FIG. 9, a CRG guide 82 as a guide member is provided in the image forming apparatus 1 and guides a portion-to-be-guided 32*d* of the process cartridge 5, so that the process cartridge 5 is placed at a normal position in the image forming apparatus 1.

As shown in FIG. 6, with respect to the light source 81 which is an LED lamp, during the mounting of the process cartridge 5, it is difficult to dispose the light source 82 inside the rotatable portion 18*a* with respect to the longitudinal direction while avoiding interference with an opening and closing locus of the rotatable portion 18*a* of the shutter member 18. For that reason, the light source 81 is provided outside a CRG side end surface 82*d* of the CRG guide 82 with respect to the longitudinal direction.

Next, the structure of the shutter member 18 will be described. As shown in FIGS. 4 and 5, the shutter member 18 includes the rotatable portion (connecting portion) 18*a*, a protecting portion 18*d*, a spring-hooking portion 18*c* and an acting rib portion 18*e*.

The protecting portion 18*d* is a portion (shutter portion) for covering and protecting the photosensitive drum. The rotatable portion 18*a* is provided at each of a longitudinal end portions of the protecting portion 18*d* of the shutter member 18. The longitudinal direction of the protecting portion 18*d* of the shutter 18 is parallel to the axial direction of the photosensitive drum 2. As shown in FIGS. 4 and 5, the rotatable portion 18*a* is a portion for connecting the protecting portion 18*d* with a main body portion (including the cleaning frame 32, the outer casing 62 supported by the cleaning frame 32, and the like) of the process cartridge 5. By the connection of the rotatable portion 18*a* in such a manner, as described later in detail with reference to FIG. 4, the protecting member 18*d* is movable (rotatable) relative to the main body portion of the process cartridge 5. At one longitudinal end portion of the shutter member 18*m*, as shown in FIG. 4, a peripheral portion of a supporting hole (engaging portion) 18*b* of the rotatable portion 18*a* and an outer periphery of the supporting portion 62*a* of the outer casing 62 engage with each other. At the other longitudinal end portion of the shutter member 18, as shown in FIG. 5, an inner periphery of a snap-fitting portion (engaging portion) 18*g* of the rotatable portion 18*a* and an outer periphery of the supporting portion 62*c* of the outer casing 62 engage with each other. As a result, the rotatable portion 18*a* of the shutter member 18 is supported at each of the longitudinal end portions of the pre-exposure member 80. That is, the rotatable portion 18*a* of the shutter member 18 overlaps with the pre-exposure member 80 with respect to the axial direction of the photosensitive drum 2. The incident portion (light-receiving portion) 80*b* at the end surface of the pre-exposure member 80 is positioned outside the rotatable portion 18*a* with respect to the axial direction. As shown in FIG. 6, a center axis 18*h* as a rotation center of the supporting hole 18*b* and the snap-fitting portion 18*g* coincides with a center axis 61*a* of the lens 61. Further, as shown in FIG. 1, when the shutter member 18 is viewed in the axial direction of the photosensitive drum 2, the center axis 18*h* as the rotation center of the snap-fitting portion 18*g* falls within a region of the incident portion 80*b*, and therefore it can be said that the snap-fitting portion 18*g* is in the same position as the incident portion 80*b*.

Figure 7:
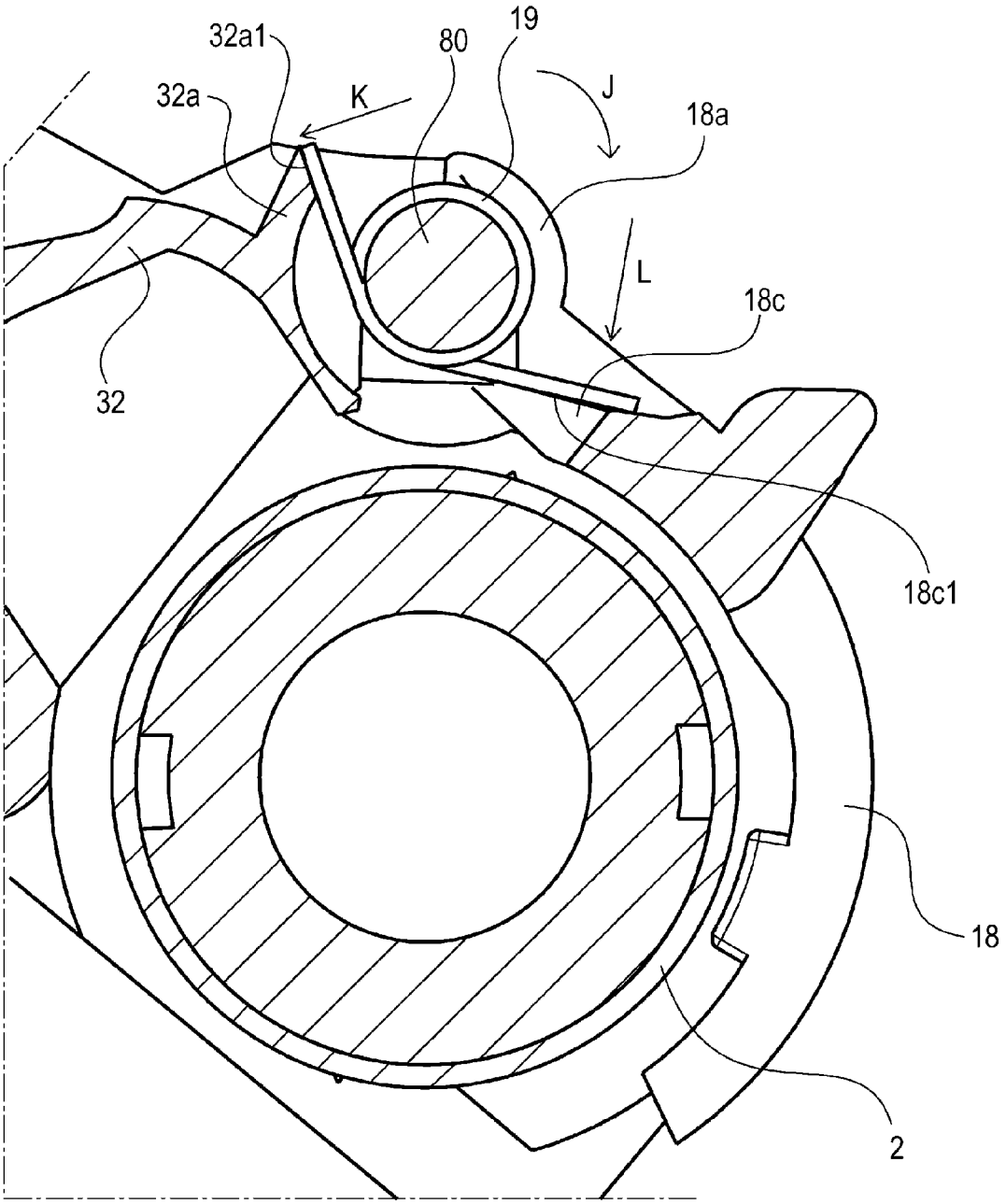
FIG. 7 is a schematic sectional view showing a structure of the shutter member and an urging member.

As shown in FIG. 7, an urging member 19 which is a helical torsion (coil) spring is hooked between a spring-hooking portion 32*a* of the cleaning frame 32 and the spring-hooking portion 18*c*. By the urging member 19, a force is exerted on a surface 32*a*1 of the spring-hooking portion 32*a* in an arrow K direction, and a force is exerted on a surface 18*c*1 of the spring-hooking portion 18*c* in a perpendicular direction (arrow L direction), and therefore the rotatable portion 18*a* receives an urging force in an arrow J direction relative to the cleaning frame 32. That is, the shutter member 18 is always urged by the urging member 19 toward the closed position where the shutter member 18 covers the photosensitive drum 2.

The acting rib portion 18*e* (FIG. 4) extends to an outside of a surface 32*b* of the cleaning frame 32 with respect to the longitudinal direction. The acting rib portion 18*e* contacts a surface 82*a* (FIG. 8) of the CRG guide 82 provided in the image forming apparatus 1 during the mounting of the process cartridge 5 in the image forming apparatus 1, so that the shutter member 18 acts on the surface 82*a*, and thus opens. The shutter member 18 opens, as shown in FIG. 3, by moving toward the downstream side with respect to the rotational direction (arrow A direction) of the photosensitive drum 2. An opening and closing method of the shutter member 18 will be described later.

(Shutter Member Opening and Closing Method)

Figure 8:
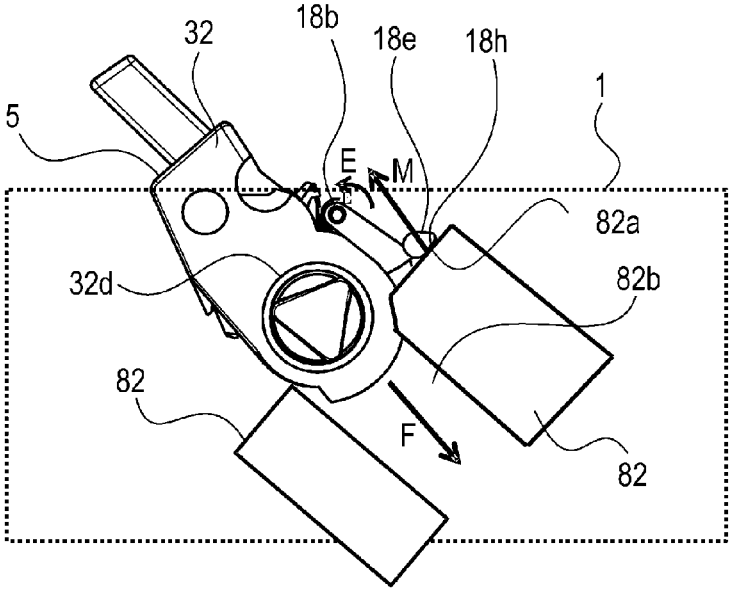
In FIG. 8, (a) to (c) are schematic views for illustrating a manner of opening the shutter member.
Figure 8:
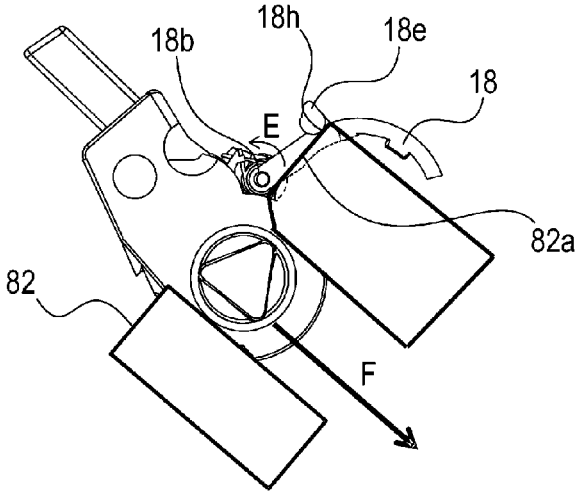
Figure 8:
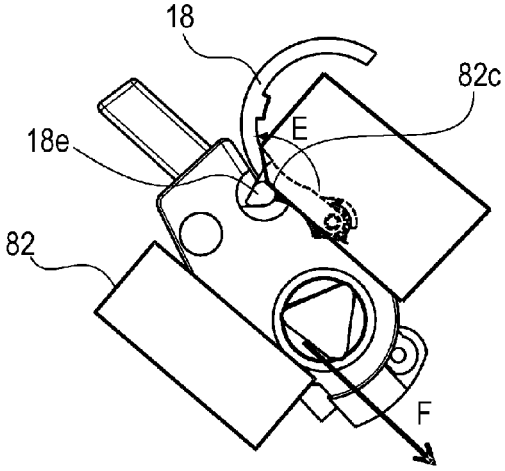

A rotating method of the shutter member will be described using FIGS. 8 and 9. In FIG. 8, (a) to (c) are schematic views showing a manner of opening the shutter member. FIG. 9 is a schematic view showing a space between the apparatus main assembly and the process cartridge during the mounting of the process cartridge in the apparatus main assembly.

As shown in (a) of FIG. 8, when the process cartridge 5 is mounted in the image forming apparatus 1, the portion-to-be-guided 32*d* of the cleaning frame 32 is mounted in the guide groove 82*b* of the CRG guide 82 provided in the image forming apparatus 1.

At that time, an acting surface 18*h* of the acting rib portion 18*e* of the shutter member 18 contacts the surface 82*a* of the CRG guide 82 and receives a force M. By receiving the force M, the shutter member 18 rotates from a state of the closed position (the position where the shutter member 18 covers the photosensitive drum 2) toward the arrow E direction with the supporting hole 18*b* as a supporting point. In this arrow E direction, the photosensitive drum 2 rotates toward a downstream side with respect to the rotational direction (arrow A direction of FIG. 3) thereof.

Then, when the process cartridge 5 is gradually mounted in an arrow F direction, as shown in (b) of FIG. 8, the acting surface 18*h* continuously contacts the surface 82*a*, so that the shutter member 18 further rotates in the arrow E direction. As a result, the protecting portion 18*d* of the shutter member 18 moves toward the open position (the position where the shutter member 18 exposes the photosensitive drum 2).

Then, when the process cartridge 5 is further mounted in the arrow F direction, as shown in (c) of FIG. 8, the acting rib portion 18*e* enters the positioning guide groove 82*b* of the CRG guide 82. At that time, the shutter member 18 is urged by the urging member 19 in a direction opposite to the arrow E direction, and therefore the acting rib portion 18*e* gradually enters a mounting position while contacting a guide surface 82*c* of the CRG guide 82.

Finally, as shown in FIG. 9, the process cartridge 5 is mounted in a positioning position of the image forming apparatus 1, but the shutter member 18 is accommodated in a space between the cleaning frame 32 and a fixing (means) cover 84 for protecting the fixing means 12 of the image forming apparatus 1.

Here, the shutter member 18 is constituted so that the photosensitive drum 2 is exposed by moving from the closed position (FIG. 1) to the open position (FIG. 2) through movement toward the downstream side with respect to the rotational direction (FIG. 3) of the photosensitive drum 2. On the other hand, in the downstream side of the exposure portion of the photosensitive drum 2 with respect to the rotational direction A, the pre-exposure member 80 is disposed. Accordingly, when the shutter member 28 moves toward the downstream side of the rotational direction A and thus opens, the pre-exposure member 80 overlaps with the rotation locus of the rotatable portion 18*a*, so that there is a liability that the shutter member 18 covers the light-receiving portion 80*b* or blocks an optical path along which the light enters.

However, in this embodiment, as shown in FIG. 1, the supporting portion 62*a* of the pre-exposure member 80 and the supporting hole 18*b* of the rotatable portion 18 engage with each other, so that the rotatable portion 18 rotates along the periphery of the pre-exposure member 80. Therefore, there is no need to dispose the shutter member inside the incident portion 80*b* of the pre-exposure member 80 with respect to the longitudinal direction so as to avoid interference with the rotation locus of the rotatable portion 18*a*, and the neighborhood of the photosensitive drum 2 constitutes a rotation-supporting point. When the pre-exposure member 80 positioned in the neighborhood of the photosensitive drum 2 constitutes the rotation-supporting point, the process cartridge 5 is downsized.

Further, by disposing the rotatable portion 18*a* so as to overlap with the pre-exposure member 80, the incident portion (light-receiving portion) 80*b* of the pre-exposure member 80 can be disposed outside the rotatable portion 18*a* with respect to the axial direction. Even in a constitution in which the shutter member 18 moves in the rotational direction A of the photosensitive drum 1 and thus opens, the incident portion 80*b* of the pre-exposure member 80 is exposed without being covered with the shutter member 18 and can be caused to approach the light source 81. For that reason, the shutter member can be disposed while suppressing an increase in cost through an increase in light quantity of pre-exposure light. Further, the rotation-supporting point of the rotatable portion 18*a* overlaps with the axis of the lens 61 of the pre-exposure member 80, so that the process cartridge 5 is downsized.

Other Embodiments

The above-described constitution realizes one of embodiments in which the process cartridge according to Embodiment 1 is capable of efficiently ensuring the opening and closing space of the shutter member while ensuring the light quantity of the pre-exposure light.

Figure 10:
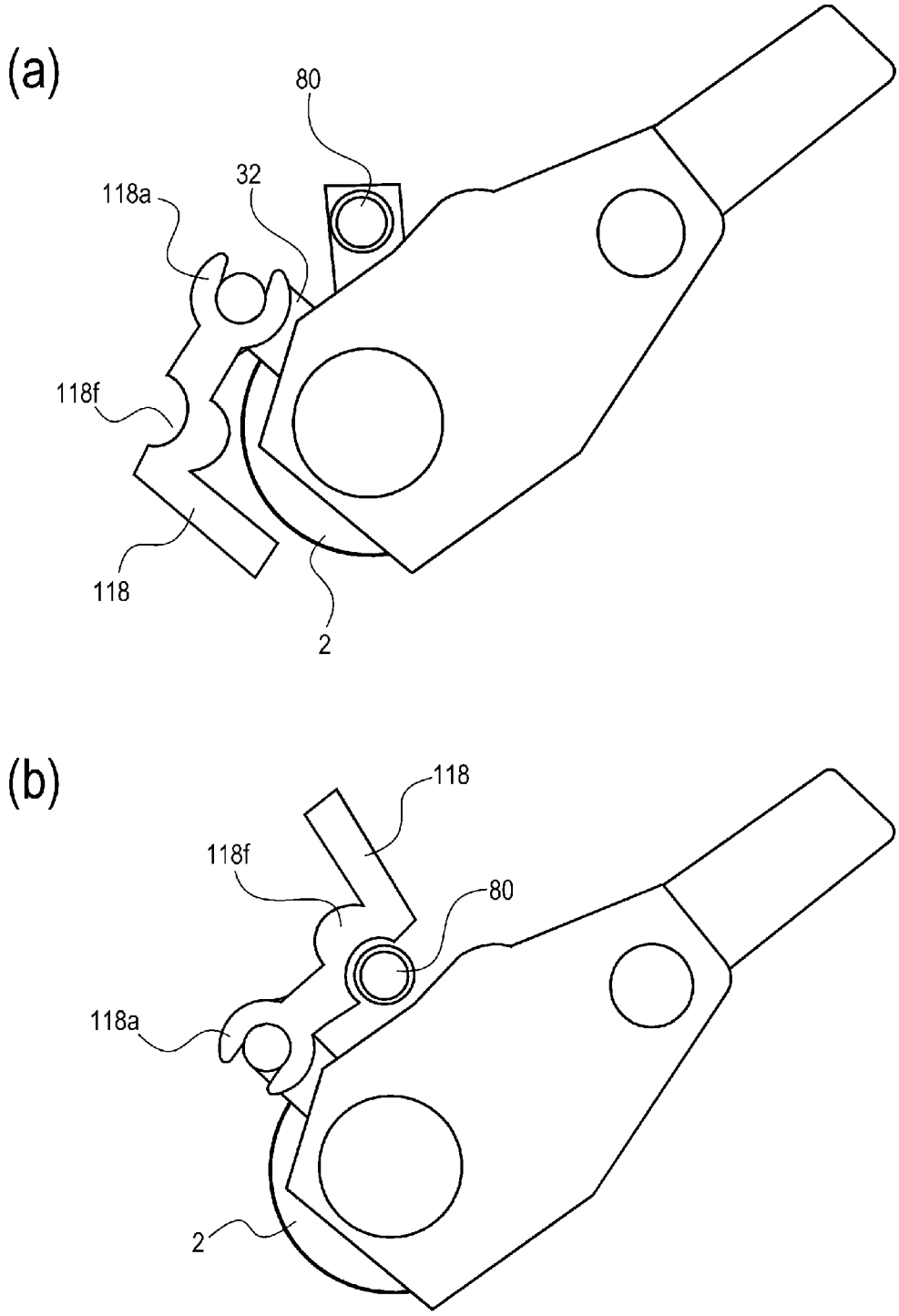
In FIG. 10, (a) and (b) are schematic sectional views for illustrating a state of a shutter member during opening and closing in embodiment.

In the above, a realizing method in which the rotation center of the rotatable portion coincides with the axis of the pre-exposure member was described, but as shown in FIG. 10, a constitution in which a rotatable portion 118*a* includes a retracted portion 118*f* retracted from the pre-exposure member 80 at an open position of a shutter member 118 may also be employed. According to this constitution, similarly as in Embodiment 1, it is possible to realize an improvement in design latitude of the opening and closing of the shutter member while suppressing the increase in cost through the increase in light quantity of the pre-exposure light.

At that time, in Embodiment 1, the shutter member 118 is supported by the pre-exposure member 80, but may also be supported by the cleaning frame 32.

Figure 11:
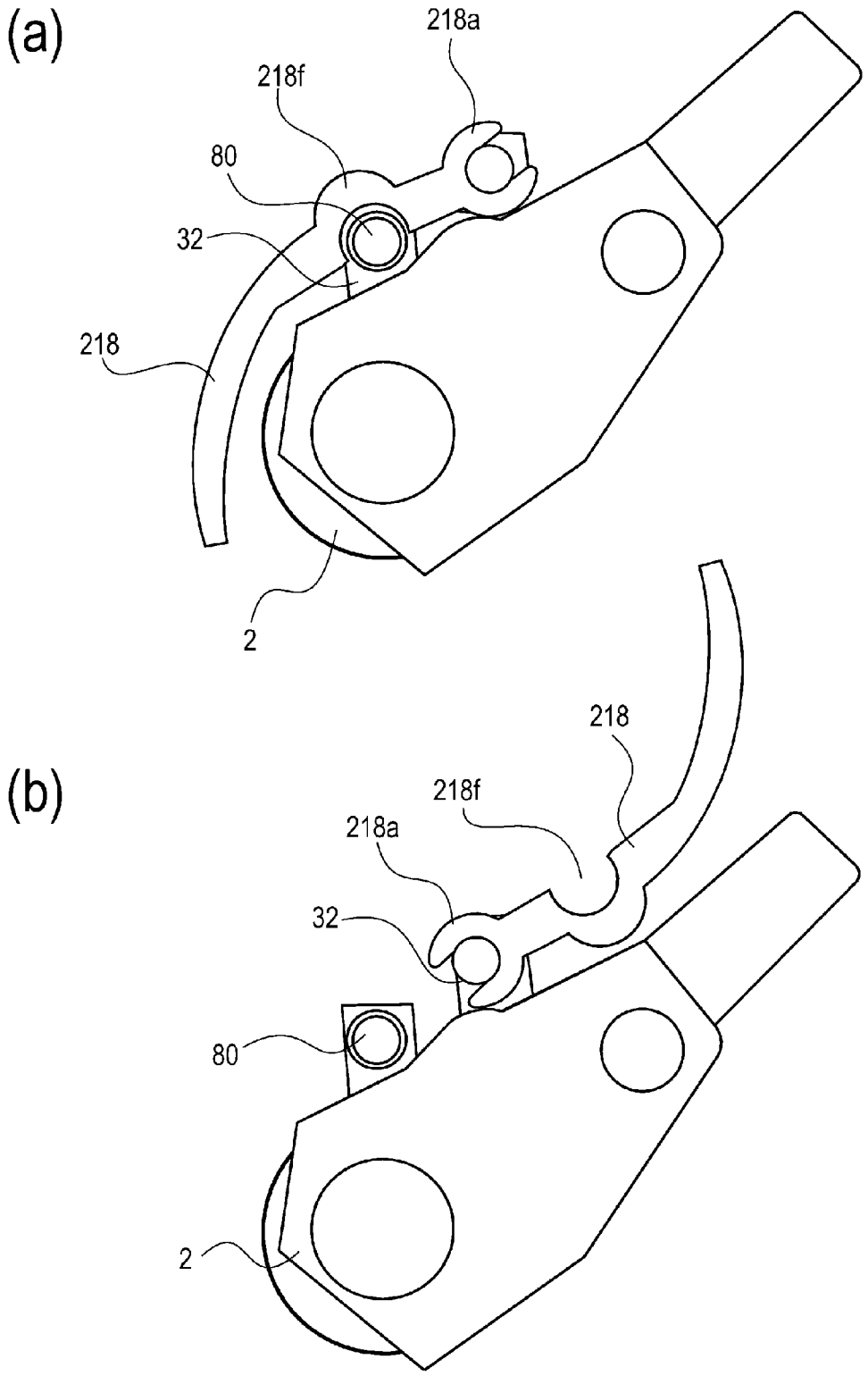
In FIG. 11, (a) and (b) are schematic view for illustrating a state of a shutter member during opening and closing in another embodiment.
Figure 12:
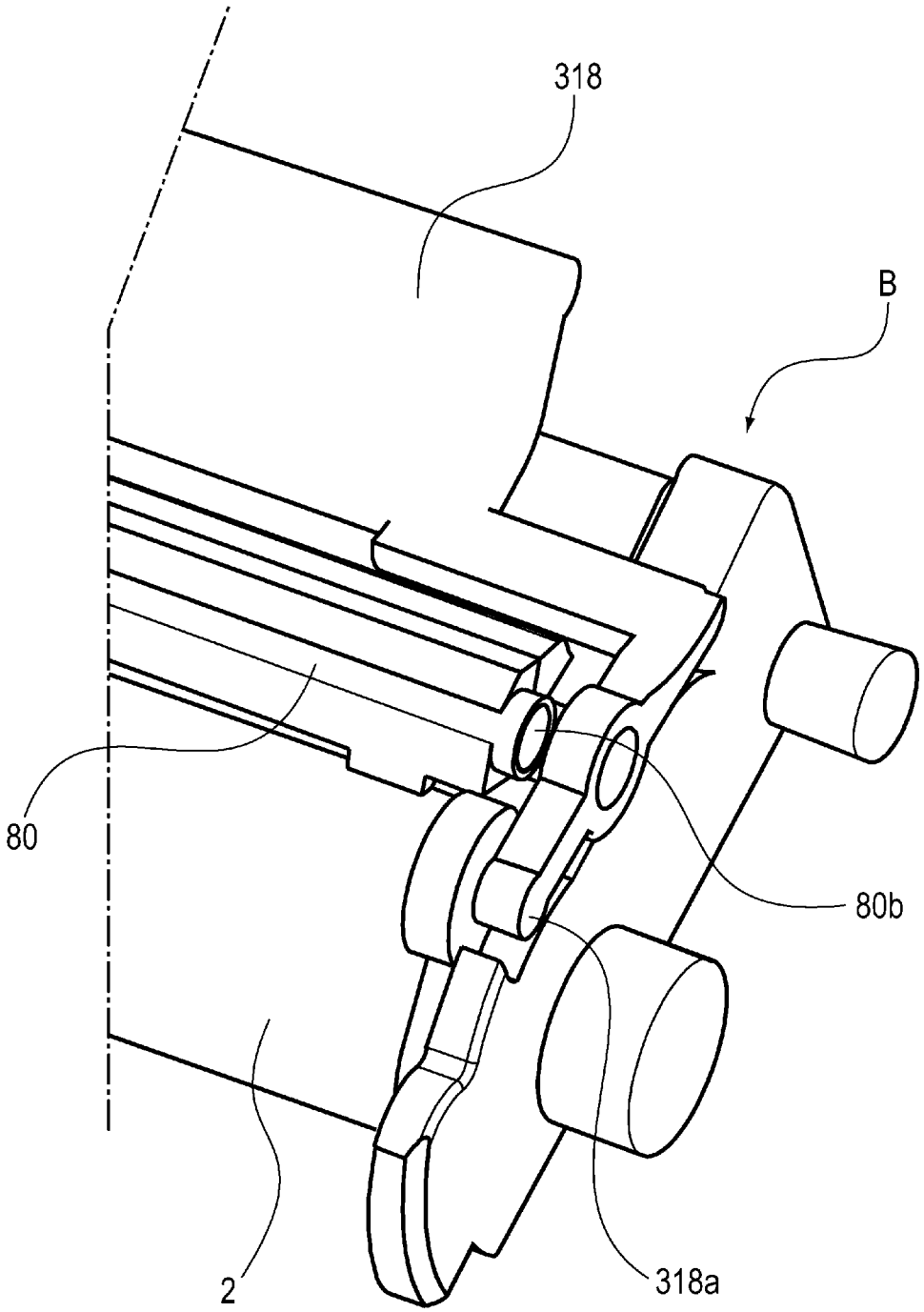
FIG. 12 is a perspective view for illustrating a conventional example.

Further, as shown in FIG. 11, a constitution in which a rotatable portion 218*a* includes a retracted portion 218*f* retracted from the pre-exposure member 80 at a closed position of a shutter member 218 may also be employed. Even in this constitution, similarly as in Embodiment 1, it is possible to realize an improvement in design latitude of the opening and closing of the shutter member while suppressing the increase in cost through the increase in light quantity of the pre-exposure light.

At that time, in Embodiment 1, the shutter member 218 is supported by the pre-exposure member 80, but may also be supported by the cleaning frame 32.

In the above-described embodiment, as the process cartridge detachably mountable to the main assembly of the image forming apparatus, the process cartridge integrally including the photosensitive drum, and the charging means, the developing means and the cleaning means which are the process means actable on the photosensitive drum was described as an example. However, the process cartridge is not limited thereto. For example, a process cartridge such as a drum cartridge including, in addition to the photosensitive drum, at least the charging means may also be used. By applying the present invention to this cartridge, it is possible to realize the improvement in design latitude of the opening and closing of the shutter member while suppressing the increase in cost through the increase in light quantity of the pre-exposure light.

Further, in the above-described embodiment, the printer was described as an example, but the present invention is not limited thereto. For example, other image forming apparatuses such as a copying machine, a facsimile machine and a multi-function machine having functions of these machines may also be used. By applying the present invention to cartridges used in these image forming apparatuses, it is possible to obtain a similar effect.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-183925 filed on Sep. 10, 2014, which is hereby incorporated by reference herein in its entirety.

What is claimed is:

1. A process cartridge detachably mountable to a main assembly of an image forming apparatus, said process cartridge comprising:

a photosensitive drum;

a light guide member for irradiating a surface of said photosensitive drum with light at a position downstream of a transfer position where a developer image is transferred from said photosensitive drum onto a developer image receiving material and upstream of a charging position where said photosensitive drum is electrically charged with respect to a rotational direction of said photosensitive drum;

a shutter portion movable between a closed position where said shutter portion covers said surface of said photosensitive drum and an open position where said surface of said photosensitive drum is exposed; and a connecting portion, provided at each of end portions of said shutter portion with respect to an axial direction of said photosensitive drum, for movably connecting said shutter portion relative to a main body portion of said process cartridge, wherein said light guide member includes an incident portion, at one end portion thereof with respect to the axial direction of said photosensitive drum, for irradiating said surface of said photosensitive drum with light incident on said incident portion, and wherein said incident portion is positioned outside said connecting portion with respect to the axial direction of said photosensitive drum.

2. A process cartridge according to claim 1, wherein said connecting portion rotates relative to said main body portion to move relative to said main body portion, and a rotation center of said connecting portion is in the same position as said light guide member as seen in the axial direction of said photosensitive drum.

3. A process cartridge according to claim 2, wherein said connecting portion includes an engaging portion engaging with said light guide member and rotates about a center axis of said engaging portion.

4. A process cartridge according to claim 3, wherein said light guide member includes a light-guiding member for guiding the light incident on said incident portion toward said photosensitive drum and an outer casing member, provided with an opening for permitting irradiation of said surface of the photosensitive drum with the light, for covering said light-guiding member, wherein said outer casing member includes a supporting portion for supporting said connecting portion, and wherein said engaging portion engages with an outer peripheral surface of said supporting portion at one end portion of said supporting portion with respect to the axial direction of said photosensitive drum, and said connecting portion moves around a periphery of said light guide member.

5. A process cartridge according to claim 1, wherein said connecting portion includes a retracted portion retracted from said light guide member when said shutter portion is in the closed position.

6. A process cartridge according to claim 1, wherein said connecting portion includes a retracted portion retracted from said light guide member when said shutter portion is in the open position.

7. A process cartridge according to claim 1, wherein, when said shutter portion is in the open position, said shutter portion is disposed downstream of a position thereof when said shutter portion is in the closed position with respect to the rotational direction of said photosensitive drum.

8. A process cartridge according to claim 1, wherein light emitted from a light source provided in the main assembly is incident on said incident portion.

9. A process cartridge detachably mountable to a main assembly of an image forming apparatus, said process cartridge comprising:

a photosensitive drum;

a light guide member for irradiating a surface of said photosensitive drum with light at a position downstream of a transfer position where a developer image is transferred from said photosensitive drum onto a developer image receiving material and upstream of a charging position where said photosensitive drum is electrically charged with respect to a rotational direction of said photosensitive drum;

a shutter portion movable between a closed position where said shutter portion covers said surface of said photosensitive drum and an open position where said surface of said photosensitive drum is exposed; and a connecting portion provided at each of end portions of said shutter portion with respect to an axial direction of said photosensitive drum, wherein said connecting portion connects said shutter portion with a main body portion of said process cartridge, and said connecting portion is rotatable relative to said main body portion, wherein a rotation center of said connecting portion and said light guide member are in the same position as seen from the axial direction of said photosensitive drum.

* * * * *